US007181996B1

(12) United States Patent
Chu

(10) Patent No.: US 7,181,996 B1
(45) Date of Patent: Feb. 27, 2007

(54) RATCHET WRENCH HAVING TWO DRIVING DEVICES

(76) Inventor: Te Chen Chu, No. 369, Seafu Road, Seafu Li, Tali City, Taichung Hsien 41263 (TW)

( * ) Notice: Subject to any disclaimer, the term of this patent is extended or adjusted under 35 U.S.C. 154(b) by 0 days.

(21) Appl. No.: 11/297,605

(22) Filed: Dec. 8, 2005

(51) Int. Cl.
*B25B 17/00* (2006.01)
*B25B 13/46* (2006.01)

(52) U.S. Cl. ..... 81/57.29; 81/58.1

(58) Field of Classification Search ..... 81/57.29, 81/57.39, 58.1, 62
See application file for complete search history.

(56) References Cited

U.S. PATENT DOCUMENTS 2,206,802 A * 7/1940 Brenning ..... 81/57.29
3,272,037 A * 9/1966 Bruehl ..... 81/57.29
4,296,654 A 10/1981 Mercer ..... 81/57.26
4,362,072 A * 12/1982 Tillman ..... 81/57.29
5,058,463 A * 10/1991 Wannop ..... 81/57.29
5,584,220 A * 12/1996 Darrah et al. ..... 81/57.29
6,070,499 A 6/2000 Wisbey ..... 81/57.29
6,311,584 B1 11/2001 Chu ..... 81/57.29
6,457,386 B1 10/2002 Chiang ..... 81/62

* cited by examiner

*Primary Examiner*—David B. Thomas
(74) *Attorney, Agent, or Firm*—Charles E. Baxley

(57) ABSTRACT

A ratchet wrench includes a handle having an internal gear formed in a head, two annular members rotatably received in the head and each having an internal gear, a stem rotatably engaged in the handle and having a pinion for engaging with and for rotating the annular members relative to the head. A shank is rotatably engaged in the head and includes four spring biased pawls each having one or more teeth for engaging with and for controlling the driving direction of the shank by the head or the annular members and the stem. The shank includes a through engaging hole having two open ends for selectively engaging with driven members by disposing the shank up aide down relative to the driven members.

9 Claims, 3 Drawing Sheets

RATCHET WRENCH HAVING TWO DRIVING DEVICES

BACKGROUND OF THE INVENTION

1. Field of the Invention

The present invention relates to a ratchet wrench, and more particularly to a ratchet wrench having two driving or output structures or devices and having a structure for simplifying the manufacturing procedures and for decreasing the manufacturing cost.

2. Description of the Prior Art

Typical ratchet wrenches or socket wrenches may comprise an input shaft and an output shaft coupled together with a jointed or angle adjustable structure for allowing the input shaft and the output shaft to be rotated relative to each other to various angular positions.

For example, U.S. Pat. No. 4,296,654 to Mercer discloses one of the typical adjustable angled socket wrench extensions including an angle adjustable structure coupled between the input shaft and the output shaft for allowing the input shaft to be rotated relative to the output shaft to various angular positions. However, the socket wrench extension includes only one driving structure or device for rotating or driving the output shaft.

U.S. Pat. No. 6,070,499 to Wisbey discloses a typical ratchet wrench including two modes of reciprocating manual input, and including an output driving member having a polygonal projection for engaging with and for driving fasteners, tool extensions, or the like. However, a complicated selector switch is required to be engaged into the tiny ratchet wrench for controlling the driving direction of the output driving member.

U.S. Pat. No. 6,311,584 to Chu discloses another typical ratchet wrench including an additional output driving device also having an output driving stem for engaging with and for driving fasteners, tool extensions, or the like. However, similarly, a complicated selector switch is required to be engaged into the tiny ratchet wrench for controlling the driving direction of the output driving device.

U.S. Pat. No. 6,457,386 to Chiang discloses a further typical ratchet wrench including dual driving means device also having an output driving member for engaging with and for driving fasteners, tool extensions, or the like. However, similarly, a complicated selector switch is required to be engaged into the tiny ratchet wrench for controlling the driving direction of the output driving device.

The present invention has arisen to mitigate and/or obviate the afore-described disadvantages of the conventional ratchet wrenches.

SUMMARY OF THE INVENTION

The primary objective of the present invention is to provide a ratchet wrench including two driving or output structures or devices and having a structure for simplifying the manufacturing procedures and for decreasing the manufacturing cost.

In accordance with one aspect of the invention, there is provided a ratchet wrench comprising a handle including a head provided on one end, and including a chamber formed in the head, and including an internal gear provided in the head, and including a bore formed in the handle and communicating with the chamber of the head, a lower annular member and an upper annular member rotatably received in the chamber of the head, and each including a peripheral gear provided thereon, the peripheral gears of the lower and the upper annular members being faced toward each other, the lower and the upper annular members each including an internal gear provided in an inner peripheral portion thereof, a stem rotatably engaged in the bore of the handle and including a pinion provided on one end and extended into the chamber of the head for engaging with the peripheral gears of the lower and the upper annular members and for rotating the lower and the upper annular members relative to the head when the stem is rotated relative to the handle, a shank rotatably engaged in the chamber of the head, two notches oppositely formed in the shank, and two recesses oppositely formed in the shank, two first pawls received in the notches of the shank respectively and each including at least one tooth for being selectively biased to engage with the internal gear of the head and to control a driving direction of the shank by the head, and two second pawls received in the recesses of the shank respectively and each including at least one tooth for being selectively biased to engage with the internal gears of the lower and the upper annular members respectively and to control a driving direction of the shank by the lower and the upper annular members and the stem. The shank includes an engaging hole formed through the shank and having two open ends and having a non-circular cross section for engaging with driven members, the two open ends of the engaging hole of the shank allow the driven members to be engaged into the engaging hole of the shank via either of the two open ends of the shank, or for selectively engaging the shank with the driven members by disposing the shank up aide down relative to the driven members, and thus for allowing the shank to be rotated or driven by the head in different directions.

The shank includes two spring members each having one end engaged with the shank and another end engaged with the first pawls and for resiliently biasing the tooth of the first pawls to engage with the internal gear of the head.

The shank includes two spring members each having one end engaged with the shank and another end engaged with the second pawls and for resiliently biasing the tooth of the second pawls to engage with the internal gears of the lower and the upper annular members respectively.

The head includes a peripheral rib extended radially into the chamber of the head, and the internal gear of the head is provided on the peripheral rib of the head. The head includes an upper peripheral shoulder and a lower peripheral shoulder formed by the peripheral rib for rotatably receiving the lower and the upper annular members respectively.

The stem includes a hand grip provided on an outer end for rotating the stem relative to the handle. The stem includes a peripheral groove formed therein, and the handle includes a catch engaged into the bore thereof and engaged with the peripheral groove of the stem for anchoring the stem to the handle and for preventing the stem from being moved longitudinally or axially relative to the handle.

The shank includes a peripheral flap extended radially and outwardly therefrom for engaging with the lower annular member and for anchoring the lower annular member and the shank to the head. The shank may further include an outer thread for threading with a locking member which is engaged with the upper annular member for anchoring the upper annular member and the shank to the head.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
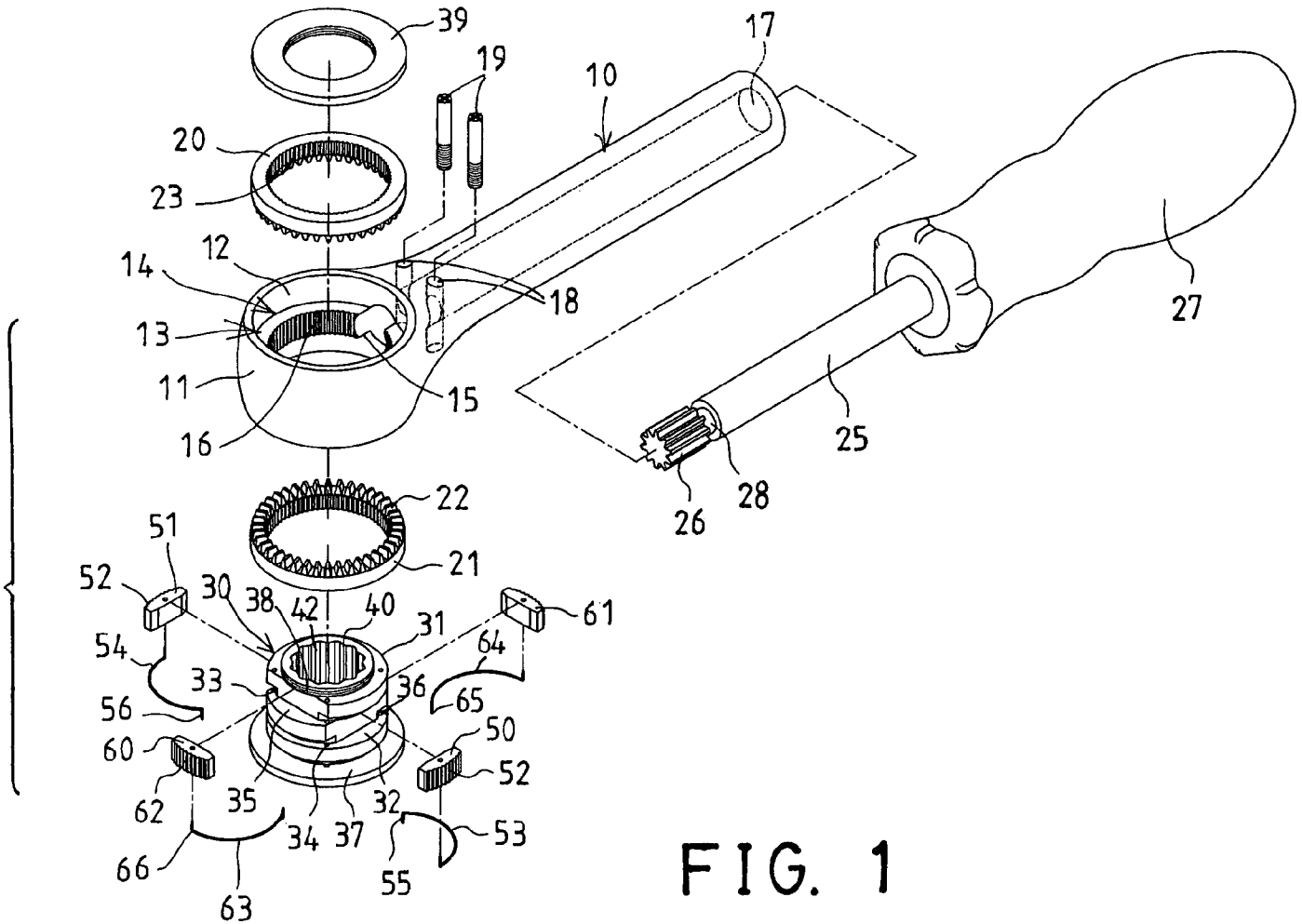
FIG. 1 is an exploded view of a ratchet wrench in accordance with the present invention.

Referring to the drawings, and initially to FIGS. 1–4, a ratchet wrench in accordance with the present invention comprises a handle 10 including an enlarged head 11 formed or provided on one end thereof, and including a chamber 12 formed in the head 11, and including a peripheral rib 13 extended radially into the chamber 12 of the head 11 to form or define an upper peripheral shoulder 14 and a lower peripheral shoulder 15 therein, and including a number of teeth or an internal gear 16 formed or provided in the inner peripheral portion of the peripheral rib 13, and including a longitudinal bore 17 formed in the handle 10 and communicating with the chamber 12 of the head 11.

One or more, such as two annular members 20, 21 are rotatably received in the chamber 12 of the head 11 and engaged with the upper peripheral shoulder 14 and the lower peripheral shoulder 15 of the head 11 respectively, and each includes a number of teeth or a peripheral gear 22 formed or provided on the lower and the upper peripheral portions respectively, and each further includes a number of teeth or an internal gear 23 formed or provided in the inner peripheral portion thereof. The peripheral gears 22 of the annular members 20, 21 are faced or extended toward each other. The peripheral rib 13 of the head 11 may be engaged with the annular members 20, 21 for anchoring or positioning the annular members 20, 21 in the chamber 12 of the head 11.

A stem 25 is rotatably engaged in the bore 17 of the handle 10 and includes a pinion 26 formed or provided on one end thereof and extended into the chamber 12 of the head 11 for engaging with the peripheral gears 22 of the annular members 20, 21 (FIG. 3) and for rotating or driving the annular members 20, 21 relative to the head 11 when the stem 25 is rotated relative to the handle 10. The stem 25 includes a hand grip 27 formed or provided on the other end or the outer end thereof for rotating the stem 25 relative to the handle 10, and includes a peripheral groove 28 formed therein and preferably located close to or adjacent to the pinion 26 for positioning purposes.

The handle 10 further includes one or more, such as two apertures 18 formed in the middle portion thereof and preferably located close to or adjacent to the head 11 and communicating with or intersecting with and preferably perpendicular to the bore 17 of the handle 10, and each of the apertures 18 is provided for slidably receiving a peg or pin or catch 19 therein. The catches 19 may be engaged into or with the peripheral groove 28 of the stem 25 for anchoring the stem 25 to the handle 10 and for preventing the stem 25 from moving longitudinally or axially relative to the handle 10, and thus for stably retaining the pinion 26 in engagement with the peripheral gears 22 of the annular members 20, 21.

Figure 4:
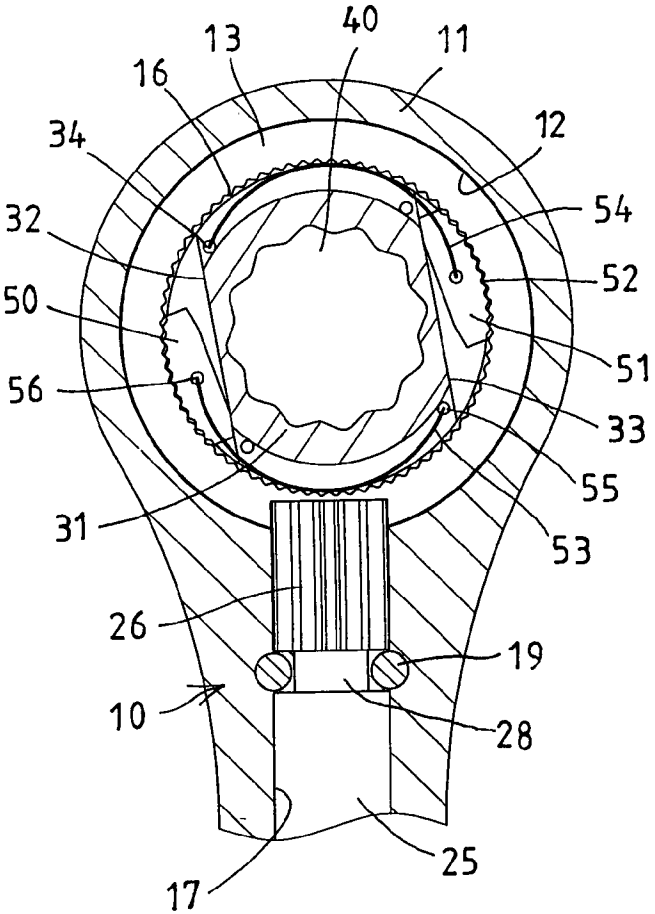
FIG. 4 is a partial cross sectional view of the ratchet wrench, taken along lines 4—4 of FIG. 2.
Figure 5:
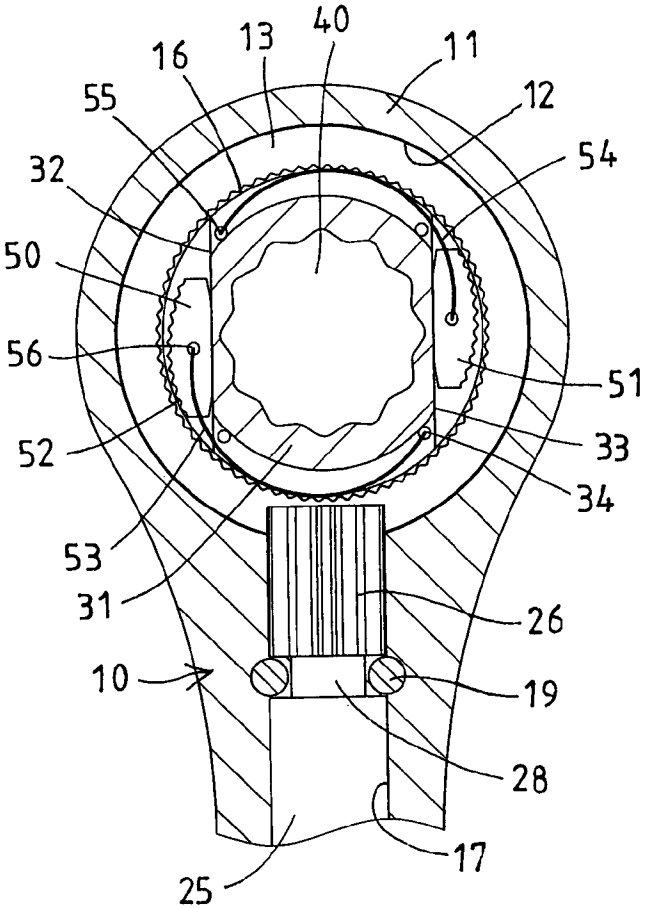
FIG. 5 is a partial cross sectional view similar to FIG. 4, illustrating the operation of the ratchet wrench.

An output driving device 30 includes a shank 31 rotatably engaged in the chamber 12 of the head 11, and includes one or more, such as two notches 32, 33 oppositely formed in the middle portion thereof each for slidably receiving a pawl 50, 51 therein, each of the pawls 50, 51 includes one or more teeth 52 extended therefrom for selectively engaging with the internal gear 16 of the head 11 (FIGS. 4, 5). One or more, such as two spring members 53, 54 each includes one end 55 for engaging into a hole 34 of the shank 31 and another end 56 for engaging into or with the respective pawls 50, 51 and for resiliently biasing the teeth 52 of the pawls 50, 51 to engage with the internal gear 16 of the head 11.

In operation, as shown in FIG. 4, the teeth 52 of the pawls 50, 51 may be biased to engage with the internal gear 16 of the head 11 by the spring members 53, 54 to allow the shank 31 of the output driving device 30 to be rotated or driven by the head 11 and the handle 10 in one direction, such as counterclockwise. On the contrary, as shown in FIG. 5, when the head 11 and the handle 10 is rotated in different direction or clockwise relative to the shank 31 of the output driving device 30, the teeth 52 of the pawls 50, 51 will be caused to be disengaged from the internal gear 16 of the head 11 due to the spring members 53, 54 to allow the head 11 and the handle 10 to be freely rotated in different direction or clockwise relative to the shank 31 of the output driving device 30 without driving the shank 31 of the output driving device 30.

Figure 2:
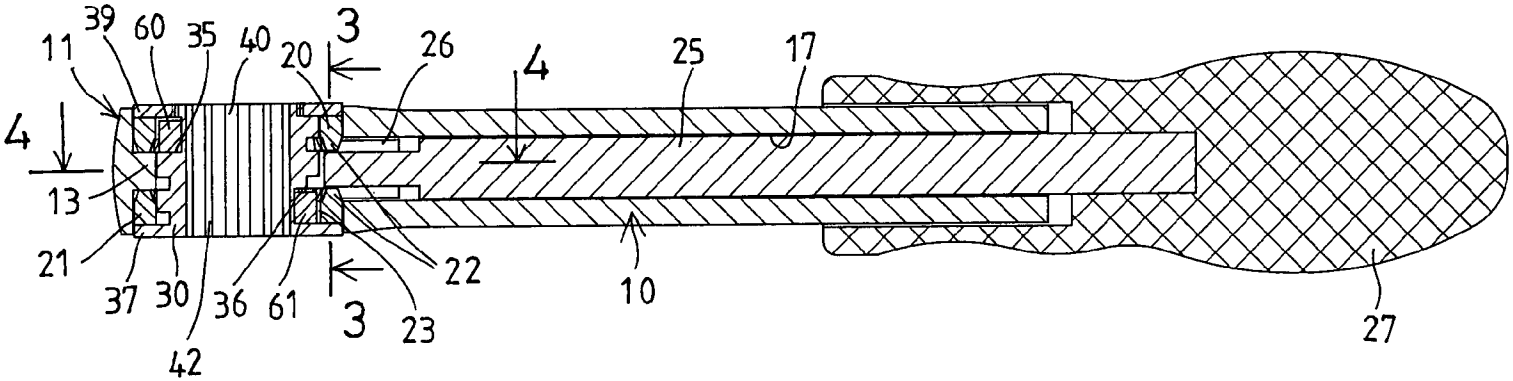
FIG. 2 is a cross sectional view of the ratchet wrench, taken along lines 2—2 of FIG. 3.
Figure 3:
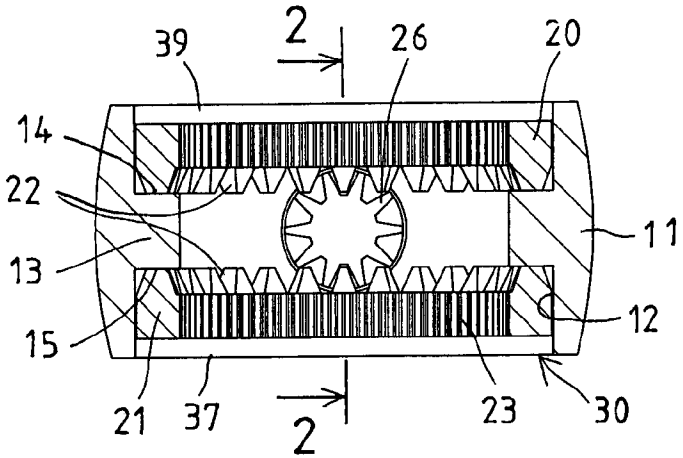
FIG. 3 is a cross sectional view of the ratchet wrench, taken along lines 3—3 of FIG. 2.

The output driving device 30 further includes one or more, such as two recesses 35, 36 oppositely formed therein, such as oppositely formed in the upper portion and the lower portion thereof respectively, and each of the recesses 35, 36 is provided for slidably receiving another pawl 60, 61 therein, each of the pawls 60, 61 includes one or more teeth 62 extended therefrom for selectively engaging with the internal gears 23 of the annular members 20, 21 respectively (FIG. 2). One or more, such as two spring members 63, 64 each includes one end 65 for engaging into the shank 31 and another end 66 for engaging into or with the respective pawls 60, 61 and for resiliently biasing the teeth 62 of the pawls 60, 61 to engage with the internal gears 23 of the annular members 20, 21 respectively.

In operation, the teeth 62 of the pawls 60, 61 may also be biased to engage with the internal gears 23 of the annular members 20, 21 respectively by the spring members 63, 64 to allow the shank 31 of the output driving device 30 to be rotated or driven by the annular members 20, 21 and the stem 25 in one direction. On the contrary, when the annular members 20, 21 are rotated in different direction by the stem 25, the teeth 62 of the pawls 60, 61 will be caused to be disengaged from the internal gears 23 of the annular members 20, 21 respectively due to the spring members 63, 64, and thus to allow the annular members 20, 21 to be freely rotated in different direction relative to the shank 31 of the output driving device 30 without driving the shank 31 of the output driving device 30.

The output driving device 30 includes an enlarged peripheral flap 37 extended radially and outwardly therefrom, such as extended outwardly from the lower portion of the shank 31 for engaging with the lower annular member 21 and for anchoring or positioning the annular member 21 and the output driving device 30 to the head 11. The output driving device 30 further includes an outer thread 38 formed or provided on the upper portion of the shank 31 for engaging with or for threading with a locking member 39 which may be engaged with the upper annular member 20 for anchoring or positioning the annular member 20 and thus the output driving device 30 to the head 11.

The output driving device 30 further includes an engaging hole 40 formed through the shank 31 and having two open ends 42 and having a non-circular cross section for receiving or for engaging with various driven members, fasteners, tool extensions (not shown) or the like. It is to be noted that the two open ends 42 of the engaging hole 40 of the output driving device 30 are arranged to allow the driven members, the fasteners or the tool extensions to be engaged into the engaging hole 40 of the output driving device 30 via either of the two open ends 42 of the output driving device 30, and to allow the driven members, the fasteners or the tool extensions to be rotated or driven by the output driving device 30 in either the counterclockwise direction or the clockwise direction when the output driving device 30 is disposed up side down relative to the driven members, the fasteners or the tool extensions or the like.

For example, when the ratchet wrench is arranged in the status as shown in FIGS. 4 and 5, the shank 31 of the output driving device 30 may be rotated or driven by the head 11 and the handle 10 in one direction, such as counterclockwise, and may be freely rotated in different direction or clockwise relative to the head 11 and the handle 10 when the head 11 and the handle 10 is rotated clockwise relative to the shank 31 of the output driving device 30. In this arrangement, it is preferable that the shank 31 of the output driving device 30 is arranged to be rotated or driven clockwise relative to the head 11 and the handle 10 by the annular members 20, 21 and the stem 25.

On the contrary, when the ratchet wrench is arranged in the up side down status relative to that shown in FIGS. 4 and 5, the shank 31 of the output driving device 30 may be rotated or driven by the head 11 and the handle 10 in the opposite direction, such as clockwise, and may be freely rotated in different direction or counterclockwise relative to the head 11 and the handle 10 when the head 11 and the handle 10 is rotated counterclockwise relative to the shank 31 of the output driving device 30. In this arrangement, it is preferable that the shank 31 of the output driving device 30 is arranged to be rotated or driven counterclockwise relative to the head 11 and the handle 10 by the annular members 20, 21 and the stem 25.

It is to be noted that the shank 31 of the output driving device 30 may be rotated or driven by the head 11 and the handle 10 in a great driving torque or force such that the shank 31 of the output driving device 30 and thus the driven members, the fasteners or the tool extensions may primarily and forcefully rotated or driven by the head 11 and the handle 10. The hand grip 27 and the stem 25 may be rotated relative to the handle 10 with a relatively decreased driving torque as compared with the driving force applied to the handle 10, such that the shank 31 of the output driving device 30 and thus the driven members, the fasteners or the tool extensions may only be rotated or driven by the hand grip 27 and the stem 25 with a relatively decreased driving torque.

It is further to be noted that the teeth 52 of the pawls 50, 51 may be resiliently biased to engage with the internal gear 16 of the head 11 by the spring members 53, 54 to control the shank 31 of the output driving device 30 to be rotated or driven by the head 11 and the handle 10 in one active direction only. No selector switch is required to be engaged into the tiny head 11 for controlling the driving direction of the output driving device 30, such that the shank 31 and the pawls 50, 51 and the other parts or members may be made relatively stronger to further increase the driving torque of the wrench. The cited or conventional arts failed to provide a ratchet wrench having two or duel driving devices and having no selector switch provided therein and having a shank 31 that includes an engaging hole 40 having two open ends 42 for selectively engaging with various driven members, fasteners, tool extensions or the like from either ends 42 of the engaging hole 40 of the shank 31.

Accordingly, the ratchet wrench in accordance with the present invention includes two driving or output structures or devices and includes a structure for simplifying the manufacturing procedures and for decreasing the manufacturing cost.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench comprising:

a handle including a head provided on one end, and including a chamber formed in said head, and including an internal gear provided in said head, and including a bore formed in said handle and communicating with said chamber of said head, a lower annular member and an upper annular member rotatably received in said chamber of said head, and each including a peripheral gear provided thereon, said peripheral gears of said lower and said upper annular members being faced toward each other, said lower and said upper annular members each including an internal gear provided in an inner peripheral portion thereof, a stem rotatably engaged in said bore of said handle and including a pinion provided on one end and extended into said chamber of said head for engaging with said peripheral gears of said lower and said upper annular members and for rotating said lower and said upper annular members relative to said head when said stem is rotated relative to said handle, a shank rotatably engaged in said chamber of said head, two notches oppositely formed in said shank, and two recesses oppositely formed in said shank, two first pawls received in said notches of said shank respectively and each including at least one tooth for being selectively biased to engage with said internal gear of said head and to control a driving direction of said shank by said head, two second pawls received in said recesses of said shank respectively and each including at least one tooth for being selectively biased to engage with said internal gears of said lower and said upper annular members respectively and to control a driving direction of said shank by said lower and said upper annular members and said stem, and said shank including an engaging hole formed through said shank and having two open ends and having a non-circular cross section for engaging with driven members, said two open ends of said engaging hole of said shank allowing the driven members to be engaged into said engaging hole of said shank via either of said two open ends of said shank.

2. The ratchet wrench as claimed in claim 1, wherein said shank includes two spring members each having one end engaged with said shank and another end engaged with said first pawls and for resiliently biasing said at least one tooth of said first pawls to engage with said internal gear of said head.

3. The ratchet wrench as claimed in claim 1, wherein said shank includes two spring members each having one end engaged with said shank and another end engaged with said second pawls and for resiliently biasing said at least one tooth of said second pawls to engage with said internal gears of said lower and said upper annular members respectively.

4. The ratchet wrench as claimed in claim 1, wherein said head includes a peripheral rib extended radially into said chamber of said head, and said internal gear of said head is provided on said peripheral rib of said head.

5. The ratchet wrench as claimed in claim 4, wherein said head includes an upper peripheral shoulder and a lower peripheral shoulder formed by said peripheral rib for rotatably receiving said lower and said upper annular members respectively.

6. The ratchet wrench as claimed in claim 1, wherein said stem includes a hand grip provided on an outer end for rotating said stem relative to said handle.

7. The ratchet wrench as claimed in claim 1, wherein said stem includes a peripheral groove formed therein, and said handle includes a catch engaged into said bore thereof and engaged with said peripheral groove of said stem for anchoring said stem to said handle.

8. The ratchet wrench as claimed in claim 1, wherein said shank includes a peripheral flap extended radially and outwardly therefrom for engaging with said lower annular member and for anchoring said lower annular member and said shank to said head.

9. The ratchet wrench as claimed in claim 1, wherein said shank includes an outer thread for threading with a locking member which is engaged with said upper annular member for anchoring said upper annular member and said shank to said head.

* * * * *